US007306429B2

(12) United States Patent
Horng et al.

(10) Patent No.: US 7,306,429 B2
(45) Date of Patent: Dec. 11, 2007

(54) AXIAL-FLOW HEAT-DISSIPATING FAN

(75) Inventors: Alex Horng, Kaohsiung (TW); Yin-Rong Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 289 days.

(21) Appl. No.: 11/053,920

(22) Filed: Feb. 10, 2005

(65) Prior Publication Data

US 2006/0147305 A1 Jul. 6, 2006

(51) Int. Cl.
*F04D 29/54* (2006.01)

(52) U.S. Cl. ..... 415/210.1; 415/119; 415/211.2; 415/220

(58) Field of Classification Search ..... 415/119, 415/208.2, 210.1, 211.2, 220, 222, 223
See application file for complete search history.

(56) References Cited

U.S. PATENT DOCUMENTS 2,394,517 A * 2/1946 Ingalls ..... 415/208.2
3,378,192 A * 4/1968 Friese ..... 417/353
5,601,410 A * 2/1997 Quinlan ..... 415/119
6,158,985 A * 12/2000 Watanabe et al. ..... 417/423.14
6,318,964 B1 11/2001 Yang
6,561,762 B1 * 5/2003 Horng et al. ..... 415/211.2
6,572,336 B2 6/2003 Horng et al.
6,779,992 B2 8/2004 Lei et al.
6,827,555 B2 12/2004 Yang
2005/0002784 A1 * 1/2005 Li et al. ..... 415/220

* cited by examiner

*Primary Examiner*—Christopher Verdier
(74) *Attorney, Agent, or Firm*—Bacon & Thomas, PLLC

(57) ABSTRACT

An axial-flow heat-dissipating fan includes an impeller and a casing. The impeller includes a hub and a plurality of blades formed on the hub. The casing includes an air inlet, an air outlet, a base in the air outlet, and guiding ribs mounted between the casing and the base. Each guiding rib includes an airflow-encountering line adjacent to a trailing edge of one of the blades that is closest to the guiding rib. Two of the blades adjacent to each other overlap with each other as viewed from the longitudinal direction such that each blade has a first overlapped area and a second overlapped area, thereby increasing an air inlet amount and reducing blowing noise in the air inlet. An angle between the trailing edge of the blade and the airflow-encountering line of the guiding rib is 10°-70°, thereby reducing blowing noise in the air outlet.

16 Claims, 7 Drawing Sheets

AXIAL-FLOW HEAT-DISSIPATING FAN

BACKGROUND OF THE INVENTION

1. Field of the Invention

The present invention relates to a heat-dissipating fan. In particular, the present invention relates to an axial-flow heat-dissipating fan.

2. Description of Related Art

FIG. 1 of the drawings illustrates an impeller 10 for an axial-flow heat-dissipating fan. The impeller 10 is mounted in a casing 20 and includes a hub 101 and a plurality of blades 102. Each blade 102 is mounted on an outer periphery of the hub 101 in an inclined angle. The blades 102 drive air to flow in an axial direction. Due to the limitation of release of the mold forming the impeller 10, two blades 102 adjacent to each other cannot overlap with each other as viewed from the longitudinal direction parallel to the rotational axis of the impeller 10. The total amount of air driven by the impeller 10 is in proportion to the number or total air-driving area of the blades 102. In other words, the total amount of air driven by the impeller 10 can be increased only by overcoming the release limitation of the mold.

A complex impeller consisting of two hub parts has been disclosed in, e.g., U.S. Pat. Nos. 6,318,964 and 6,572,336. As illustrated in FIGS. 2 and 3, such a complex impeller 3 comprises a shaft 30, a complex hub 31, and a plurality of blades 32. The complex hub 31 includes an upper hub 31*a* and a lower hub 31*b*. A plurality of upper blades 32*a* are formed on an outer periphery of the upper hub 31*a*, and a plurality of lower blades 32*b* are formed on an outer periphery of the lower hub 31*b*, with the upper blades 32*a* and the lower blades 32*b* together forming the blades 32. Each blade 32 overlaps with an adjacent blade 32 as viewed from a longitudinal direction parallel to the shaft 30.

As illustrated in FIG. 3, after assembly, the leading edge 321 of each blade 32 is coincident with the trailing edge 322 of an adjacent blade 32. By such an arrangement, the number of the blades 32 and the total air-driving area of the blades 32 are increased. However, the blades 3 are not disposed properly such that the blowing noise is high.

The impeller 3 can be further assembled with a casing (not shown) to form a heat-dissipating fan. In operation, the assembled blades 32 drive air to exit the casing via an air outlet of the casing. However, the trailing edge 322 of each blade 32 and the supporting ribs in the air outlet of the casing are not well designed such that the outgoing airflow impacts the supporting ribs in the wrong direction, generating unacceptable noise in the area adjacent to the supporting ribs.

OBJECTS OF THE INVENTION

An object of the present invention is to provide an axial-flow heat-dissipating fan for increasing the air inlet amount while lowering noise at the air inlet end.

A further object of the present invention is to provide an axial-flow heat-dissipating fan for increasing the air inlet amount while lowering noise at the air outlet end.

SUMMARY OF THE INVENTION

In accordance with the present invention, an axial-flow heat-dissipating fan comprises an impeller and a casing. The impeller comprises a hub including an outer periphery and a plurality of blades formed on the outer periphery of the hub and extending in an inclined angle with respect to a longitudinal direction parallel to a rotational axis of the hub. Each blade includes a leading edge, a trailing edge, a radial inner edge, and a radial outer edge.

The casing comprises an airflow passage having an air inlet and an air outlet. The casing further comprises a base in the air outlet. A motor is mounted on the base for coupling with and driving the impeller. A plurality of guiding ribs are mounted between an inner periphery of the casing and an outer periphery of the base. Each guiding rib includes an airflow-encountering line adjacent to the trailing edge of one of the blades that is closest to the guiding rib.

Two of the blades adjacent to each other overlap with each other as viewed from the longitudinal direction such that each blade has a first overlapped area and a second overlapped area, thereby increasing an air inlet amount and reducing blowing noise in the air inlet. An angle between the trailing edge of the blade and the airflow-encountering line of the guiding rib is 10°-70°, thereby reducing blowing noise in the air outlet.

Preferably, the first overlapped area on each blade extends outward from the leading edge and the radial inner edge but spaced from the radial outer edge of the blade.

Preferably, the second overlapped area on each blade extends outward from the trailing edge and the radial inner edge but spaced from the radial outer edge of the blade.

Preferably, the airflow-encountering line of each guiding rib is tangential to the trailing edge of the blade that is closest to the guiding rib.

Preferably, each guiding rib includes a first airflow-guiding side and a second airflow-guiding side, with the airflow-encountering line formed between the first airflow-guiding side and the second airflow-guiding side. In an embodiment of the invention, the first airflow-guiding side is planar and extends in a direction parallel to the rotational axis of the hub. In another embodiment of the invention, the first airflow-guiding side is an inclined side and extends in a direction having a predetermined angle with respect to the rotational axis of the hub. The second airflow-guiding side may be arcuate.

A first reference point adjacent to the outer periphery of the base and a second reference point adjacent to the inner periphery of the casing are selected on the airflow-encountering line of each guiding rib, defining a reference line passing through the first referent point and the second reference point. An angle between the trailing edge of the blade and the reference line is 10°-70° when the airflow-encountering line is aligned with a rear end point of the blade.

Preferably, the angle between the trailing edge of the blade and the reference line is 10°-70° when the rear end point of the blade is aligned with the second reference point.

Preferably, a distance between the first reference point and the outer periphery of the base is approximately ⅕ of an overall length of the airflow-encountering line.

Preferably, a distance between the second reference point and the inner periphery of the casing is approximately ⅕ of an overall length of the airflow-encountering line.

The airflow-encountering line may be rectilinear or non-rectilinear.

The angle between the trailing edge of the blade and the airflow-encountering line of the guiding rib is preferably 20°-50°, most preferably 30°-40°.

Other objects, advantages and novel features of this invention will become more apparent from the following detailed description when taken in conjunction with the accompanying drawings.

DETAILED DESCRIPTION OF THE PREFERRED EMBODIMENTS

Figure 4:
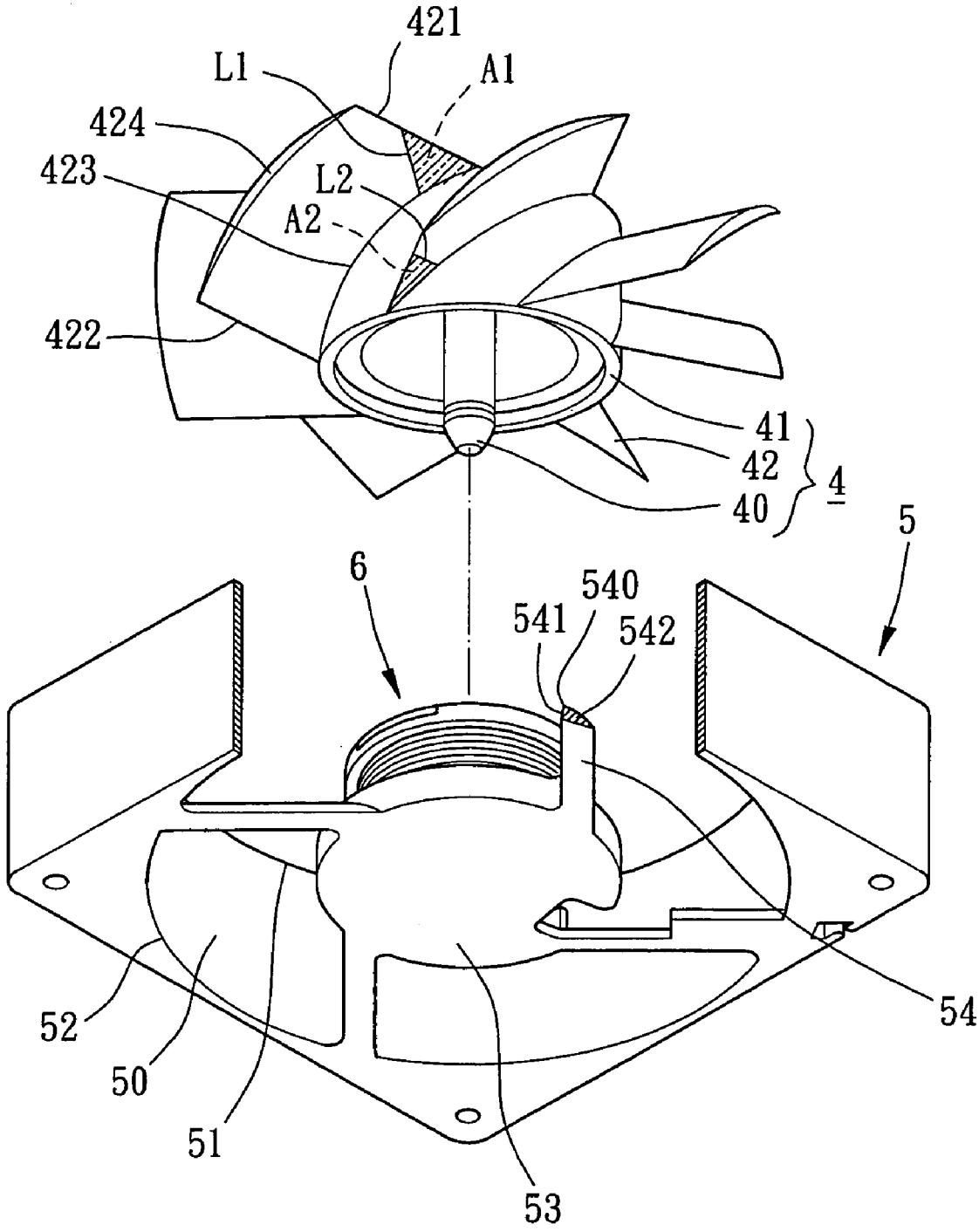
FIG. 4 is an exploded perspective view, partly cutaway, of an axial-flow heat-dissipating fan in accordance with the present invention.
Figure 5:
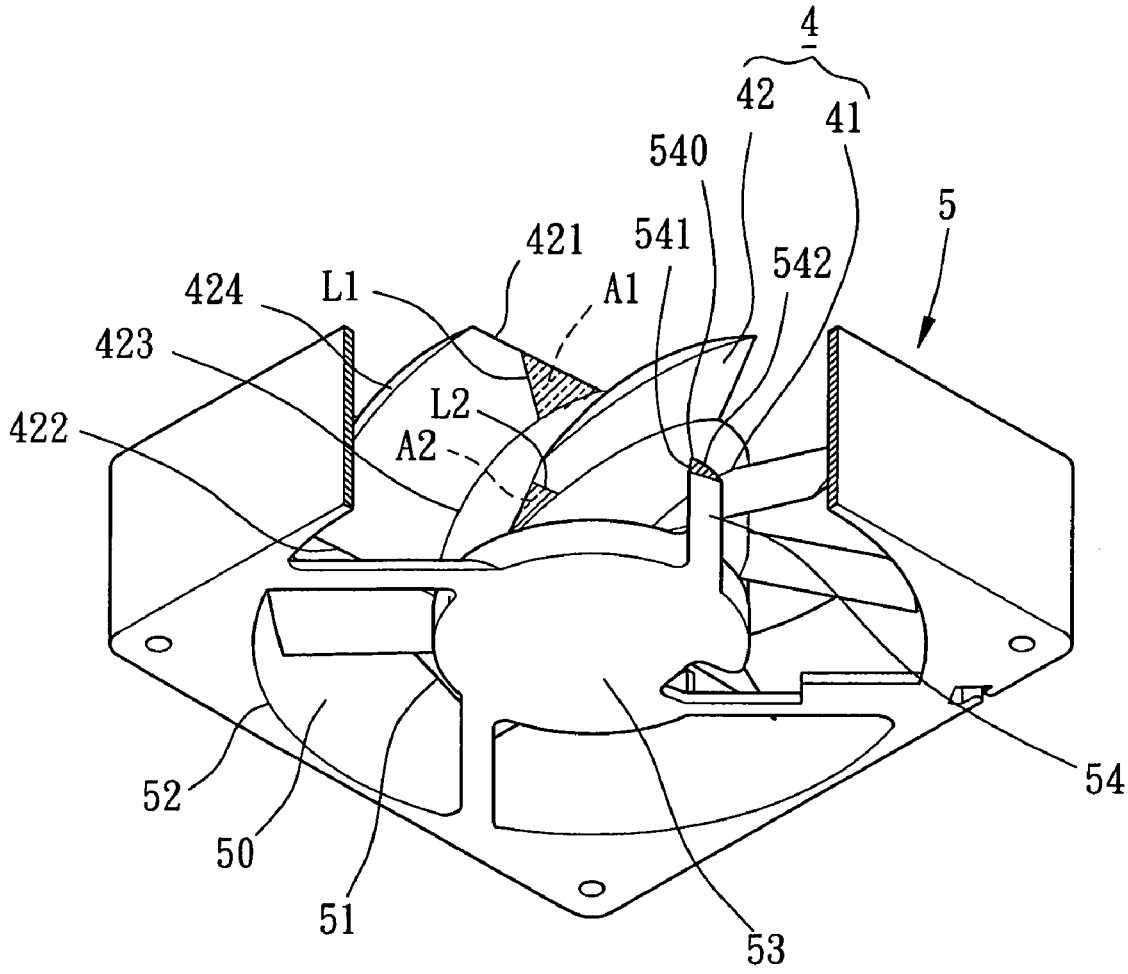
FIG. 5 is a perspective view, partly cutaway, of the axial-flow heat-dissipating fan in accordance with the present invention.

Referring to FIGS. 4 and 5, an axial-flow heat-dissipating fan in accordance with the present invention comprises an impeller 4 and a casing 5 for accommodating the impeller 4. A motor 6 is mounted in the casing 5 for driving the impeller 4 to turn.

Still referring to FIGS. 4 and 5, the impeller 4 comprises a shaft 40, a hub 41, and a plurality of blades 42. The shaft 40 extends from a center of an inner face of the hub 41 for coupling with the motor 6.

The blades 42 are symmetrically formed on an outer periphery of the hub 41 and extend in an inclined angle with respect to a longitudinal direction parallel to an extending direction of the shaft 40 (i.e., the rotational axis of the hub 41). Each blade 42 includes a leading edge 421 on an air inlet side of the blade 42, a trailing edge 422 on an air outlet side of the blade 42, a radial inner edge 423 on the outer periphery of the hub 41, and a radial outer edge 424 distal to the outer periphery of the hub 41. The leading edge 421, the trailing edge 422, the radial inner edge 423, and the radial outer edge 24 are rectilinear or curved with an appropriate radius of curvature according to product needs. For each blade 42, the leading edge 421 intersects the radial inner edge 423 at a front base point I1, the leading edge 421 intersects the radial outer edge 424 at a front end point I2, the trailing edge 422 intersects the radial inner edge 423 at a rear base point O1, and the trailing edge 422 intersects the radial outer edge 424 at a rear end point O2, best shown in FIG. 6.

Still referring to FIGS. 4 and 5, as viewed from a longitudinal direction parallel to the extending direction of the shaft 40, the trailing edge 422 of each blade 42 projects on an adjacent blade 42 along a rear projection line L1. A first longitudinal overlapped area A1 is defined by the rear projection line L1, the leading edge 421 of the adjacent blade 42, and the radial inner edge 423 of the adjacent blade 42.

Still referring to FIGS. 4 and 5, as viewed from the longitudinal direction parallel to the extending direction of the shaft 40, the leading edge 421 of each blade 42 projects on the other adjacent blade 42 along a front projection line L2. A second longitudinal overlapped area A2 is defined by the front projection line L2, the trailing edge 422 of the other adjacent blade 42, and the radial inner edge 423 of the other adjacent blade 42. None of the first overlapped area A1 and the second overlapped area A2 extend to the radial outer edge 424 of the blade 42.

Still referring to FIGS. 4 and 5, the casing 5 includes an airflow passage 50, an air inlet 51, an air outlet 52, a base 53, and a plurality of guiding ribs 54. The air inlet 51 and the air outlet 52 form two ends of the airflow passage 50. The base 53 is located in the air outlet 52 side and supported by the guiding ribs 54 that are connected to an inner periphery of the casing 5. The motor 6 is mounted on the base 54 for coupling with and driving the impeller 4.

Each guiding rib 54 includes a first airflow-guiding side 541 and a second airflow-guiding side 542. The first airflow-guiding side 541 is planar and extends in a direction parallel to the rotating axis of the shaft 40. The first airflow-guiding side 541 provides a portion of the outgoing airflow passing through the air outlet 52 with a pressure-boosting effect. The second airflow-guiding side 542 is arcuate and guides the remaining portion of the airflow to smoothly exit the casing 5 via the air outlet 52.

Figure 6:
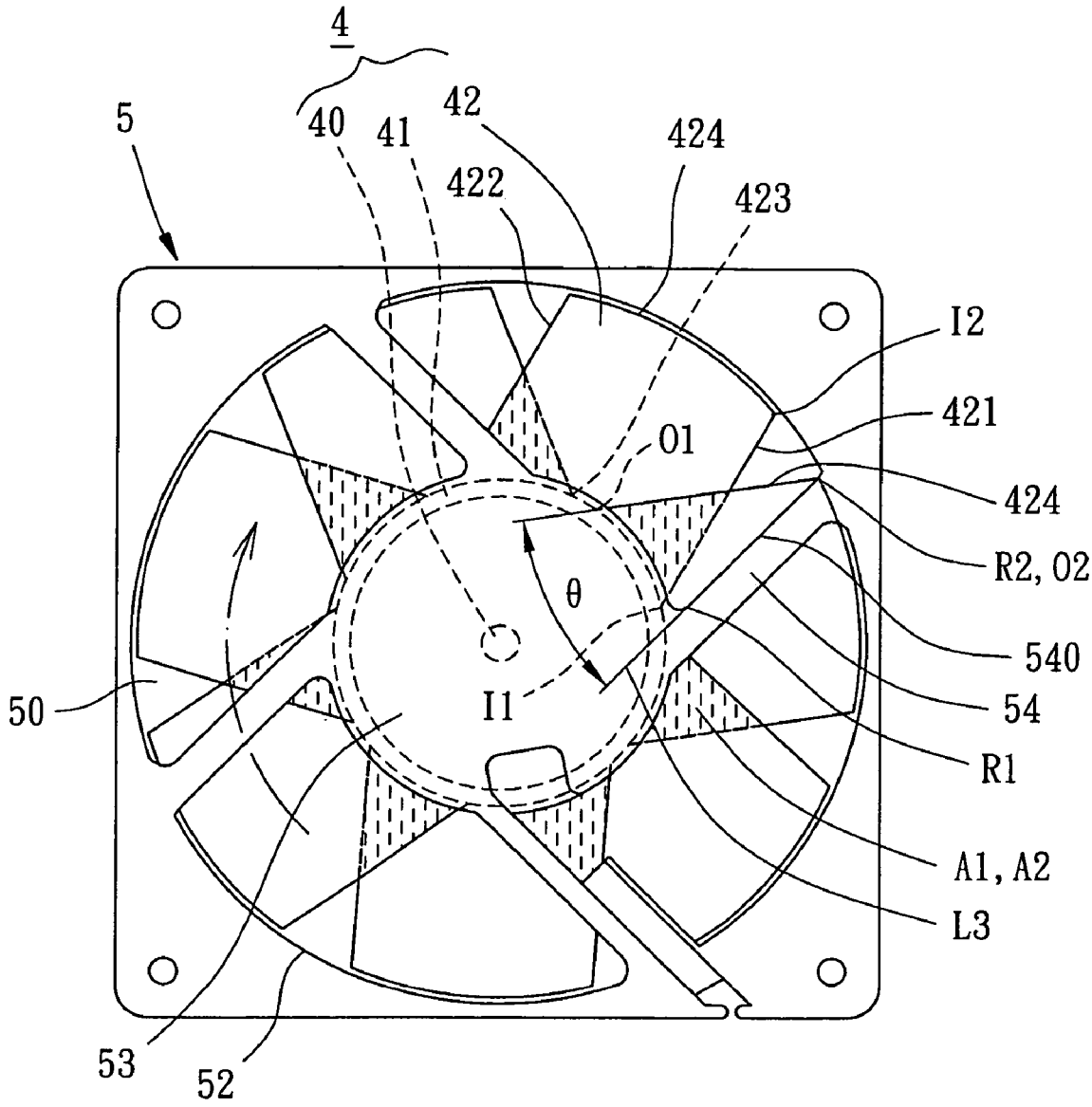
FIG. 6 is a bottom view of the axial-flow heat-dissipating fan in accordance with the present invention.

In the embodiment illustrated in FIGS. 5 and 6, two ends of each guiding rib 54 are connected to an outer periphery of the base 53 and the inner periphery of the casing 5 respectively. Further, for each guiding rib 54, an airflow-encountering line 540 is formed between the first airflow-guiding side 541 and the second airflow-guiding side 542. The airflow-encountering line 54 of each guiding rib 54 is a line tangential to the trailing edge 422 of a blade 42 closest to the guiding rib 54.

On the airflow-encountering line 54, a first reference point R1 and a second reference point R2 are selected, wherein a distance between the first reference point R1 and the outer periphery of the base 53 is approximately ⅕ of an overall length of the airflow-encountering line 54, and wherein a distance between the second reference point R2 and the inner periphery of the casing 5 is approximately ⅕ of the overall length of the airflow-encountering line 54. A reference line L3 passing through the first and second reference points R1 and R2 is thus defined. When the rear end point O2 of a blade 42 on the impeller 4 is aligned with the airflow-encountering line 540 of a guiding rib 54 (preferably aligned with the second reference point R2), an angle θ between the rear trailing edge 422 of the blade 42 and the reference line L3 of the guiding rib 54 is 10°-70°, preferably 20°-50°, and most preferably 30°-40°.

Still referring to FIGS. 5 and 6, the impeller 4 is mounted on the casing 5 to form an axial-flow heat-dissipating fan. In operation, the impeller 4 drives air into the airflow passage 50 via the air inlet 51. The airflow is boosted by the guiding ribs 54 and then exits the casing 5 via the air outlet 52. For each blade 42 and two blades 42 adjacent to the blade 42, each blade 42 has a first overlapped area A1 with one of the two adjacent blades 42 and a second overlapped area A2 with the other adjacent blade 42. None of the first overlapped area A1 and the second overlapped area A2 extend to the radial outer edge 424 of the blade 42. Further, when the front end point I2 of a blade 42 of the impeller 4 moves to a position aligned with the airflow-encountering line 540 of a guiding rib 54, the angle θ between the rear trailing edge 422 of the blade 42 and the reference line L3 of the guiding rib 54 still remains 10°-70°.

Figure 1:
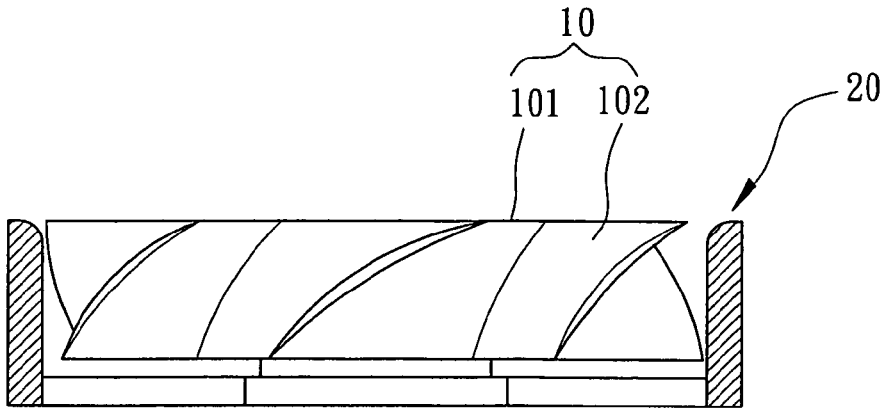
FIG. 1 PRIOR ART
FIG. 1 is a sectional view of a conventional impeller for an axial-flow heat-dissipating fan.
Figure 2:
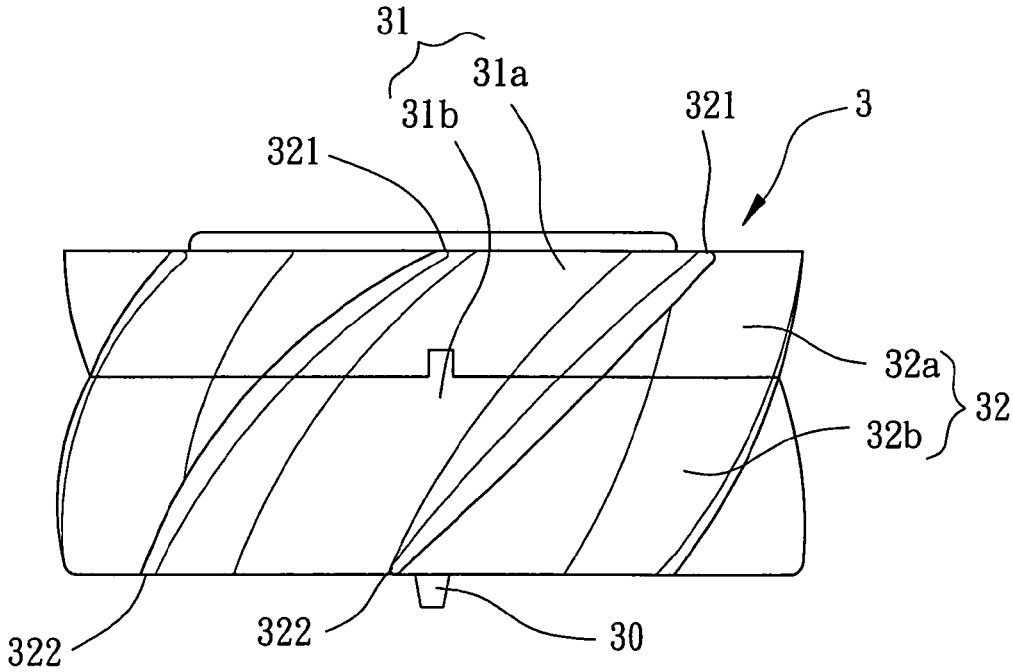
FIG. 2 PRIOR ART
FIG. 2 is a side view of another conventional impeller for an axial-flow heat-dissipating fan.
Figure 3:
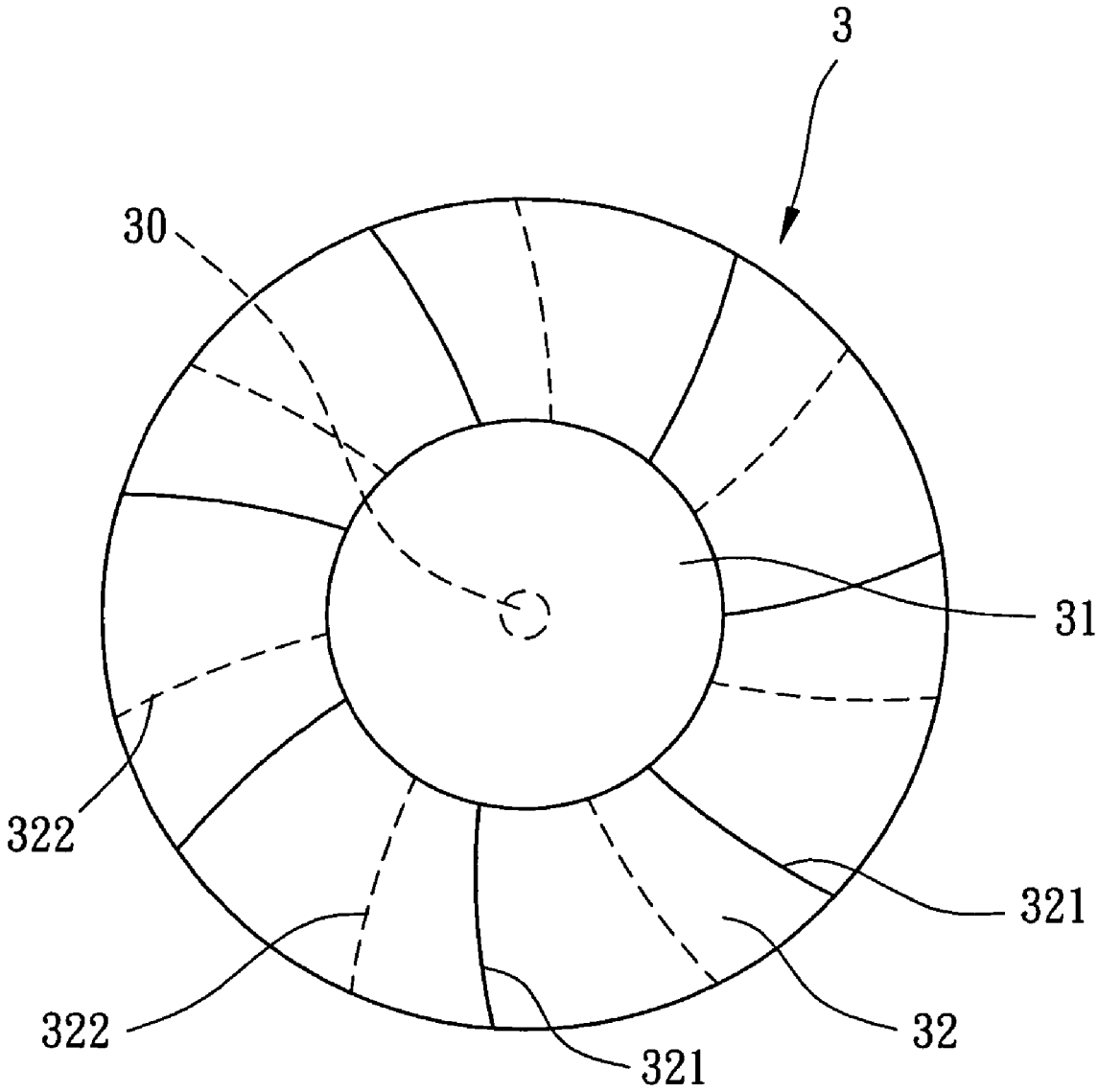
FIG. 3 PRIOR ART
FIG. 3 is a top view of the impeller in FIG. 2.

By such an arrangement, the number of the blades 42 and the total air-driving area of the blades 42 of the impeller 4 in accordance with the present invention are increased as compared to the conventional impeller 1 in FIG. 1. Further, overlapping of the blades 42 in the area adjacent to the radial outer edge 424 is avoided in the impeller 4 in accordance with the present invention as compared to the conventional impeller 3 in FIGS. 2 and 3. The noise at the air inlet end is lowered. Further, the outgoing airflow driven by the trailing edges 422 of the blades 42 moves along a direction at an optimal angle with the first air-guiding sides 541 of the guiding ribs 54, lowering the noise at the air outlet end. Accordingly, the blowing noise at the air inlet end and the air outlet end is lowered while increasing the air amount driven by the impeller 4.

Figure 7:
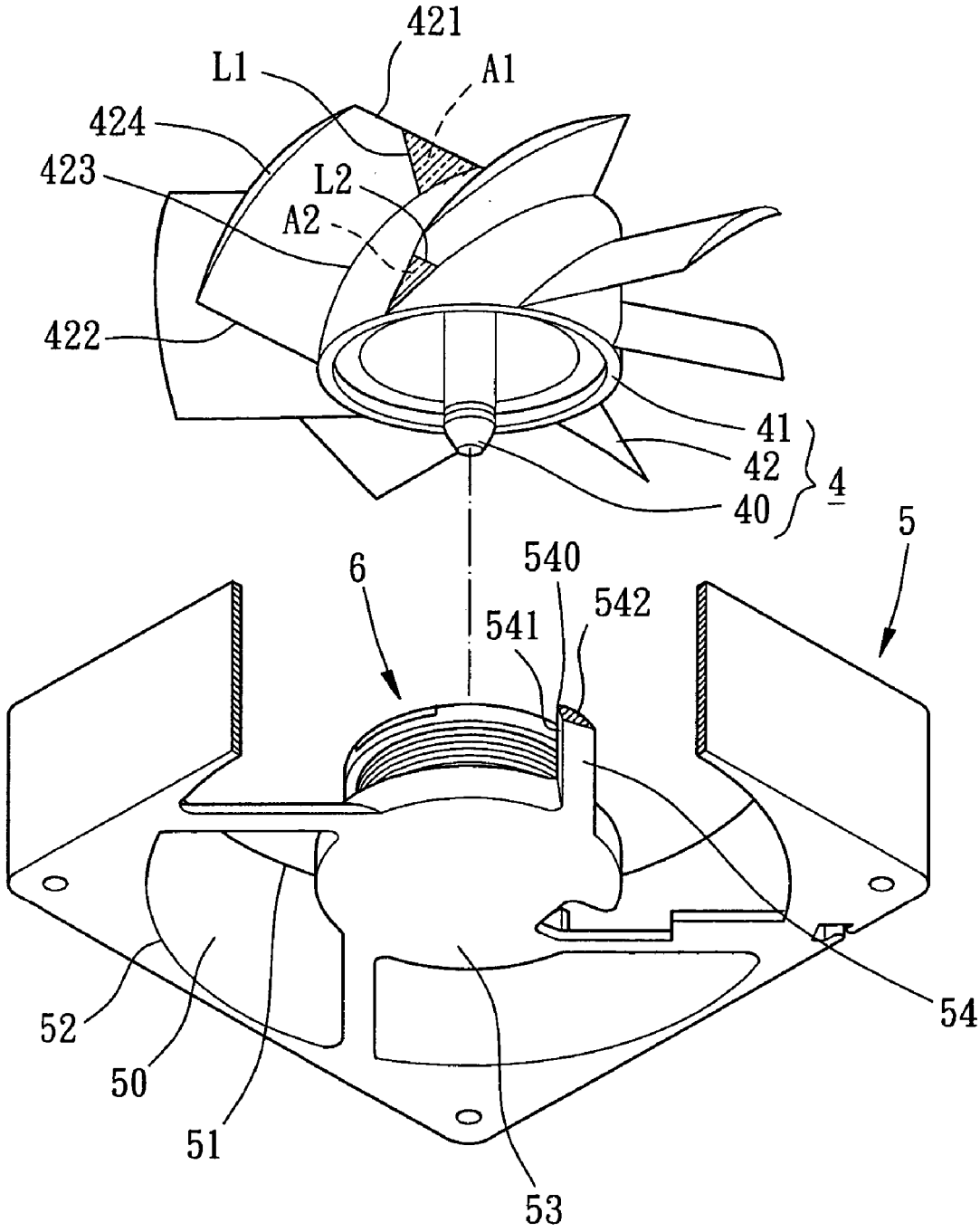
FIG. 7 is an exploded perspective view, partly cutaway, of a modified embodiment of the axial-flow heat-dissipating fan in accordance with the present invention.

FIG. 7 illustrates a modified embodiment of the invention, wherein the first airflow-guiding side 541 of each guiding rib 54 is inclined. In other words, the first airflow-guiding side 541 is at an angle with the longitudinal direction of the shaft 40. The pressure-boosting effect is further improved while guiding airflow. Again, the angle θ between the rear trailing edge 422 of the blade 42 and the reference line L3 of the guiding rib 54 is 10°-70°.

Figure 8:
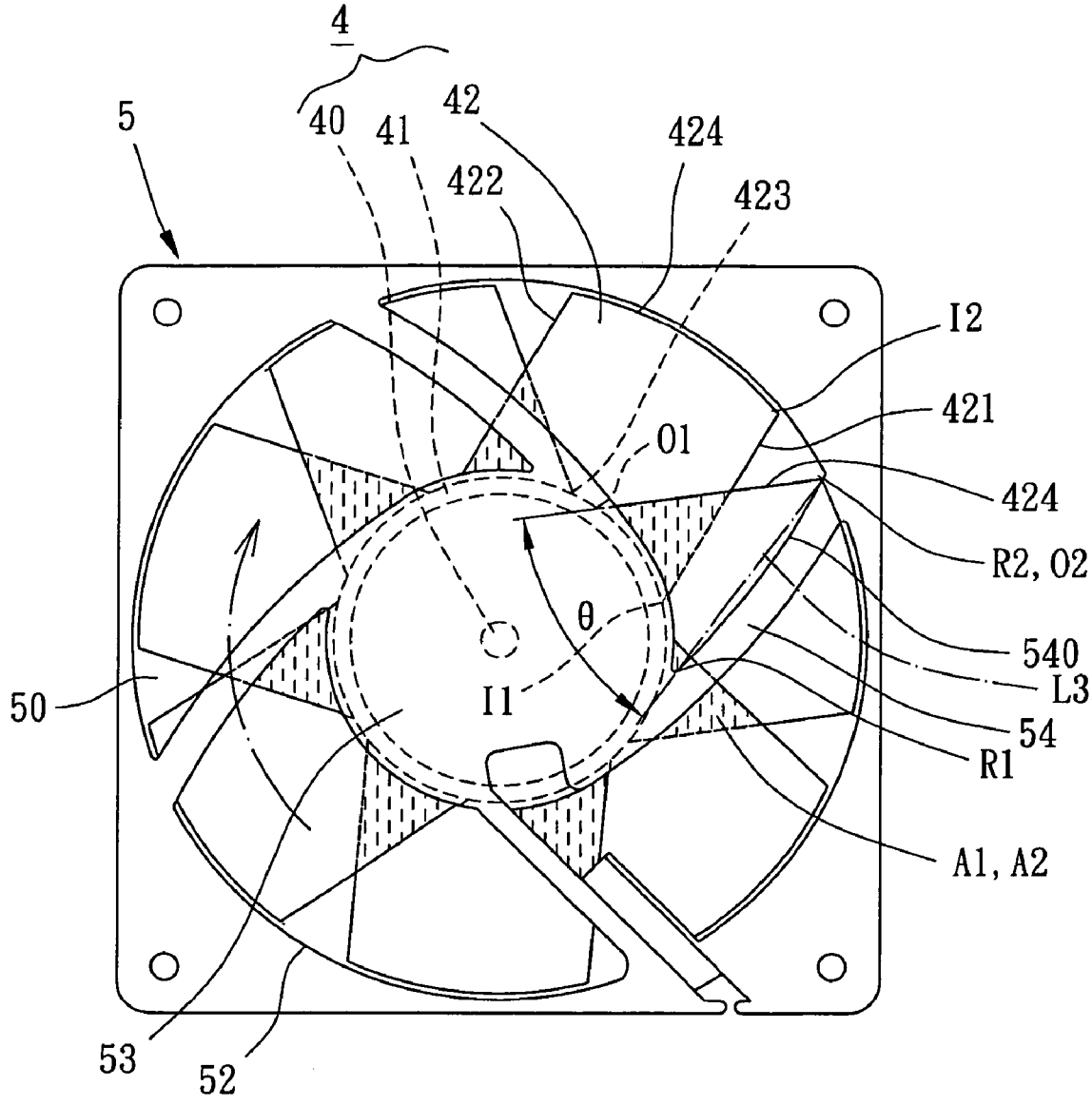
FIG. 8 is a bottom view of another modified embodiment of the axial-flow heat-dissipating fan in accordance with the present invention.

FIG. 8 illustrates another modified embodiment of the invention, wherein the airflow-encountering line 540 of each guiding rib 54 is curved or of a non-rectilinear shape. Similarly, on the airflow-encountering line 54, a first reference point R1 and a second reference point R2 are selected, wherein a distance between the first reference point R1 and the outer periphery of the base 53 is approximately ⅕ of the overall length of the airflow-encountering line 54, and wherein a distance between the second reference point R2 and the inner periphery of the casing 5 is approximately ⅕ of the overall length of the airflow-encountering line 54. A reference line L3 passing through the first and second reference points R1 and R2 is thus defined. When the rear end point O2 of a blade 42 on the impeller 4 is aligned with the airflow-encountering line 540 of a guiding rib 54 (preferably aligned with the second reference point R2), an angle θ between the rear trailing edge 422 of the blade 42 and the reference line L3 of the guiding rib 54 is 10°-70°, preferably 20°-50°, and most preferably 30°-40°. The blowing noise is lowered and the air amount driven by the impeller 4 is increased while providing a pressure-boosting effect.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An axial-flow heat-dissipating fan comprising:

an impeller comprising a hub including an outer periphery and a plurality of blades fanned on the outer periphery of the hub and extending in an inclined angle with respect to a longitudinal direction parallel to a rotational axis of the hub, each said blade including a leading edge, a trailing edge, a radial inner edge, and a radial outer edge; and a casing comprising an airflow passage having an air inlet and an air outlet, the casing further comprising a base in the air outlet, a motor being mounted on the base for coupling with and driving the impeller, a plurality of guiding ribs being mounted between an inner periphery of the casing and an outer periphery of the base, each of said guiding ribs including an airflow-encountering line adjacent and tangential to the trailing edge of one of the blades that is closest to said guiding rib;

two of the blades adjacent to each other overlapping with each other as viewed from the longitudinal direction such that each said blade has a first overlapped area and a second overlapped area.

2. The axial-flow heat-dissipating fan as claimed in claim 1, wherein the first overlapped area on each said blade extends outward from the leading edge and the radial inner edge but is spaced from the radial outer edge of the blade.

3. The axial-flow heat-dissipating fan as claimed in claim 1, wherein the second overlapped area on each said blade extends outward from the trailing edge and the radial inner edge but is spaced from the radial outer edge of the blade.

4. The axial-flow heat-dissipating fan as claimed in claim 1, wherein each said guiding rib includes a first airflow-guiding side and a second airflow-guiding side, with the airflow-encountering line fanned between the first airflow-guiding side and the second airflow-guiding side.

5. The axial-flow heat-dissipating fan as claimed in claim 4, wherein the first airflow-guiding side is planar and extends in a direction parallel to the rotational axis of the hub.

6. The axial-flow heat-dissipating fan as claimed in claim 4, wherein the first airflow-guiding side is an inclined side and extends in a direction having a predetermined angle with respect to the rotational axis of the hub.

7. The axial-flow heat-dissipating fan as claimed in claim 4, wherein the second airflow-guiding side is arcuate.

8. The axial-flow heat-dissipating fan as claimed in claim 1, wherein:

a first reference point adjacent to the outer periphery of the base and a second reference point adjacent to the inner periphery of the casing are selected on the airflow-encountering line of each said guiding rib, defining a reference line passing through the first reference point and the second reference point an angle between the trailing edge of said blade and the reference line is 10°-70° when the airflow-encountering line is aligned with a rear end point of said blade.

9. The axial-flow heat-dissipating fan as claimed in claim 8, wherein the angle between the trailing edge of said blade and the reference line is 10°-70° when the rear end point of said blade is aligned with the second reference point.

10. The axial-flow heat-dissipating fan as claimed in claim 8, wherein a distance between the first reference point and the outer periphery of the base is approximately ⅕ of an overall length of the airflow-encountering line.

11. The axial-flow heat-dissipating fan as claimed in claim 8, wherein a distance between the second reference point and the inner periphery of the casing is approximately ⅕ of an overall length of the airflow-encountering line.

12. The axial-flow heat-dissipating fan as claimed in claim 1, wherein the airflow-encountering line is rectilinear.

13. The axial-flow heat-dissipating fan as claimed in claim 1, wherein the airflow-encountering line is non-rectilinear.

14. The axial-flow heat-dissipating fan as claimed in claim 1, wherein an angle between the trailing edge of said blade and the airflow-encountering line of said guiding rib is 10°-70°.

15. The axial-flow heat-dissipating fan as claimed in claim 14, wherein an angle between the trailing edge of said blade and the airflow-encountering line of said guiding rib is 20°-50°.

16. The axial-flow heat-dissipating fan as claimed in claim 1, wherein an angle between the trailing edge of said blade and the airflow-encountering line of said guiding rib is 30°-40°.

* * * * *